US008686820B2

(12) United States Patent
Inaba et al.

(10) Patent No.: US 8,686,820 B2
(45) Date of Patent: Apr. 1, 2014

(54) REACTOR

(75) Inventors: Kazuhiro Inaba, Osaka (JP); Shinichiro Yamamoto, Osaka (JP); Haruhisa Toyoda, Osaka (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 0 days.

(21) Appl. No.: 13/502,503

(22) PCT Filed: May 27, 2011

(86) PCT No.: PCT/JP2011/062197

§ 371 (c)(1),
(2), (4) Date: Apr. 17, 2012

(87) PCT Pub. No.: WO2011/158631

PCT Pub. Date: Dec. 22, 2011

(65) Prior Publication Data

US 2012/0218066 A1 Aug. 30, 2012

(30) Foreign Application Priority Data

Jun. 17, 2010 (JP) ..... 2010-138740

(51) Int. Cl.
*H01F 27/02* (2006.01)
*H01F 27/24* (2006.01)
*H01F 17/04* (2006.01)

(52) U.S. Cl.
USPC ..... 336/83; 336/90; 336/212; 336/221; 336/233

(58) Field of Classification Search
USPC ..... 336/83, 90, 212, 221, 233
See application file for complete search history.

(56) References Cited

U.S. PATENT DOCUMENTS 6,393,691 B1 * 5/2002 Ogawa et al. ..... 29/602.1
6,456,182 B1 * 9/2002 Katayama et al. ..... 336/181
(Continued)

FOREIGN PATENT DOCUMENTS

JP 08-138947 A 5/1996
JP 2003-168610 * 6/2003
(Continued)

OTHER PUBLICATIONS

Notification of Reasons for Rejection in Japanese Patent Application No. 2010-138740, dated Nov. 12, 2013.
Extended European Search Report in European Patent Application No. 11795539.3, dated Nov. 21, 2013.

*Primary Examiner* — Elvin G Enad
*Assistant Examiner* — Kazi Hossain
(74) *Attorney, Agent, or Firm* — Venable LLP; Michael A. Sartori; Tamatane J. Aga

(57) ABSTRACT

Provided is a reactor having a small size with consideration of loss reduction. A reactor 1A includes a coil 10 and a magnetic core 20. The coil 10 is formed by winding a wire. The magnetic core 20 includes an internal core portion 21 that is inserted through the coil 10 and a couple core portion 23 that is coupled to an end of the internal core portion 21 and that covers an outer periphery of the coil 10. The core portions 21 and 23 form a closed magnetic path. An interposed core portion 25 is disposed between the coil 10 and the internal core portion 21. The reactor 1A satisfies $0<S2/S1<0.15$, where S1 is an inner cross-sectional area of the coil 10 and S2 is a cross-sectional area of the interposed core portion 25; and satisfies B1>B2 and B1>B3, where B1 is a saturation magnetic flux density of the internal core portion 21, B2 is a saturation magnetic flux density of the couple core portion 23, and B3 is a saturation magnetic flux density of the interposed core portion 25.

7 Claims, 3 Drawing Sheets

(56) References Cited

U.S. PATENT DOCUMENTS

| | | | | |
|---|---|---|---|---|
| 2005/0012581 | A1* | 1/2005 | Ono et al. | 336/90 |
| 2008/0309443 | A1* | 12/2008 | Furuya | 336/83 |
| 2012/0044033 | A1* | 2/2012 | Kawaguchi | 336/90 |
| 2012/0119869 | A1* | 5/2012 | Yamamoto | 336/212 |
| 2012/0126928 | A1* | 5/2012 | Yoshikawa et al. | 336/221 |

FOREIGN PATENT DOCUMENTS

| | | | |
|---|---|---|---|
| JP | 2008-192887 | | 8/2008 |
| JP | 2008-210820 | A | 9/2008 |
| JP | 2009-033051 | * | 2/2009 |
| WO | WO-2011/013394 | | 2/2011 |

* cited by examiner

REACTOR

TECHNICAL FIELD

The present invention relates to a reactor used as a component of an electric power converter such as a vehicle-mounted DC-DC converter. In particular, the present invention relates to a small reactor.

BACKGROUND ART

A reactor is a circuit component that increases or reduces a voltage. For example, PTL 1 describes a reactor that is used as a converter mounted in a vehicle such as a hybrid vehicle. The reactor described in PTL 1 includes a magnetic core that has an E-shaped cross section, which is a so-called pot-shaped core. The magnetic core includes a solid-cylindrical internal core portion that is disposed inside a coil, a hollow-cylindrical core portion that is disposed so as to surround the outer periphery of the coil, and a pair of disk-shaped core portions that are disposed on both end surfaces of the coil (PTL 1). In the pot-shaped core, the internal core portion and the hollow-cylindrical core portion, which are concentrically disposed, are coupled to each other by the disk-shaped core portions, and a closed magnetic path is formed. Moreover, PTL 1 discloses that the cross-sectional area of the internal core portion can be reduced by making the saturation magnetic flux density of the internal core portion be higher than those of the hollow-cylindrical core portion and the disk-shaped core portions, and thereby a small reactor can be obtained.

CITATION LIST

Patent Literature

PTL 1: Japanese Unexamined Patent Application Publication No. 2009-033051

SUMMARY OF INVENTION

Technical Problem

In order to reduce the size of such a reactor, it is preferable that the space between the coil and the internal core portion be as small as possible. However, if the gap is too small, leakage magnetic flux from the internal core portion may enter the coil and thereby loss may occur. In particular, if a gap of a non-magnetic material for inductance adjustment is disposed at an intermediate position in the axial direction of the internal core portion, leakage of magnetic flux also occurs through this gap, and thereby loss may occur in a similar manner. On the other hand, if the space between the coil and the internal core portion is too large, reduction in the size of the reactor is limited.

The present invention has been achieved in view of the background described above, and an object of the present invention is to provide a reactor having a small size with consideration of loss reduction.

Solution to Problem

A reactor according to the present invention includes a coil and a magnetic core. The coil is formed by winding a wire. The magnetic core includes an internal core portion that is inserted through the coil and a couple core portion that is coupled to an end of the internal core portion and that covers an outer periphery of the coil. The core portions form a closed magnetic path. The reactor includes an interposed core portion disposed between the coil and the internal core portion. The reactor satisfies $0<S2/S1<0.15$, where S1 is an inner cross-sectional area of the coil and S2 is a cross-sectional area of the interposed core portion; and satisfies $B1>B2$ and $B1>B3$, where B1 is a saturation magnetic flux density of the internal core portion, B2 is a saturation magnetic flux density of the couple core portion, and B3 is a saturation magnetic flux density of the interposed core portion.

With this configuration, because the space between the coil and the internal core portion is filled with the interposed core portion, leakage flux from the internal core portion to the coil is suppressed, and the rate of increase in the total loss, which is the sum of the iron loss and the copper loss, can be reduced while increasing the inductance. Moreover, because the saturation magnetic flux densities of the core portions satisfy $B1>B2$ and $B1>B3$, the cross-sectional area of the internal core portion can be made smaller than that of the case where the interposed core portion is not provided and $B1\leq B2$ is satisfied, whereby the outside diameter of the coil can be reduced and the size of the reactor can be reduced.

In the reactor according to the present invention, it is preferable that $0<S2/S1<0.04$ be satisfied.

With this configuration, the rate of increase in the total loss can be reduced while increasing the inductance, and the rate of increase in the copper loss can be suppressed.

In the reactor according to the present invention, the internal core portion may be formed from a powder molded product.

As the material of the internal core portion, a material having a saturation magnetic flux density higher than that of the couple core portion is used. A powder molded product can be preferably used as a material having a high saturation magnetic flux density.

Because a powder molded product having a three-dimensional shape can be easily formed, for example, an internal core portion having an outer shape that follows the shape of the inner peripheral surface of the coil can be easily formed.

In the reactor according to the present invention, the couple core portion and the interposed core portion may be each made of a mixture of a magnetic material and a resin; and the internal core portion, the interposed core portion, and the couple core portion may be integrated with one another through the resin.

With this configuration, when the internal core portion and the interposed core portion, and the internal core portion and the couple core portion are integrated with each other through a resin, it is not necessary to use a gap for adjusting the inductance of the reactor and an adhesive for bonding segments of the magnetic cores to each other and for bonding the segments and the gap. Therefore, the size of the reactor can be reduced further. In particular, by integrating the coil, the internal core portion, the couple core portion, and the interposed core portion with one another through the resin, a magnetic core having predetermined characteristics can be formed and the reactor can be manufactured. Thus, forming of the couple core portion and the interposed core portion, forming of the magnetic core, and manufacturing of the reactor can be performed simultaneously. Moreover, when a gapless structure described above is used, the number of components is small and the number of manufacturing steps can be reduced. Furthermore, with this configuration, because the couple core portion and the interposed core portion are each made from a mixture of a magnetic material and a resin, a magnetic core having desired magnetic characteristics can be easily formed by adjusting the mixture ratio of the magnetic material to the resin.

In the reactor according to present invention, the saturation magnetic flux density B1 of the internal core portion may satisfy 1.6 T≤B1 and 1.2×B2≤B1.

With this configuration, because the saturation magnetic flux density B1 of the internal core portion is equal to or higher than 1.2 times the saturation magnetic flux density B2 of the couple core portion, the internal core portion has a relatively sufficiently high saturation magnetic flux density, and thereby the cross-sectional area of the internal core portion can be reduced. Therefore, the size of a reactor according having this configuration can be reduced. In particular, it is preferable that the saturation magnetic flux density B1 of the internal core portion be equal to or higher than 1.5 times and more preferably be equal to or higher than 1.8 times the saturation magnetic flux density B2 of the couple core portion with no upper limit. It is preferable that the saturation magnetic flux density B1 (absolute value) of the internal core portion be as high as possible. It is preferable that B1 be equal to or higher than 1.8 T and more preferably be equal to or higher than 2 T with no upper limit. The materials of the internal core portion and the couple core portion may be adjusted so that the saturation magnetic flux densities may be in the range described above.

In the reactor according to the present invention, a relative magnetic permeability of the internal core portion may be in the range of 50 to 1000, and a relative magnetic permeability of each of the couple core portion and the interposed core portion may be in the range of 5 to 50.

With this configuration, leakage flux from the magnetic core can be reduced, and a gapless structure can be realized. A reactor according to the present invention can be easily used as a vehicle component if the couple core portion has a magnetic permeability in the range of about 5 to 30 and the internal core portion has a magnetic permeability in the range of about 100 to 500. The materials of the internal core portion, the couple core portion, and the interposed core portion may be adjusted so that the magnetic permeabilities may be in the range described above.

In the reactor according to the present invention, the reactor may further include a case that contains an assembly including the coil and the magnetic core, and the coil and the internal core portion may be sealed in the case by the resin included in the couple core portion and the interposed core portion.

With this configuration, the coil and the magnetic core are protected by the case. Moreover, it is not necessary to prepare an additional potting resin as in existing reactors, because the resin material of the couple core portion and the interposed resin portion is used as a sealing resin.

Advantageous Effects of Invention

With the reactor according to the present invention, reduction in the size of the reactor can be realized with consideration of loss reduction.

DESCRIPTION OF EMBODIMENTS

Figure 1A:
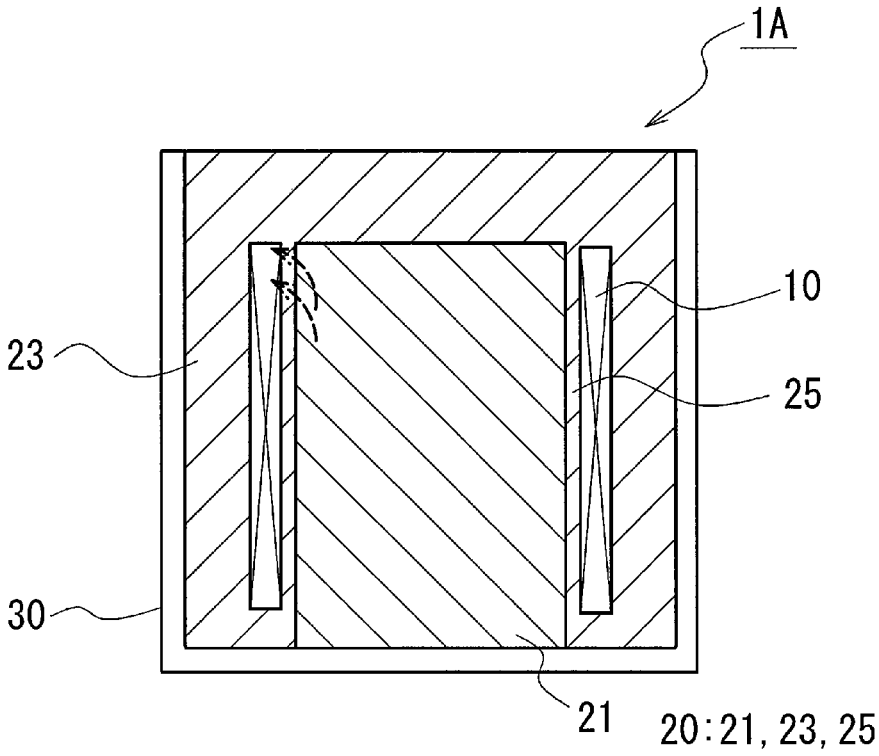
FIG. 1A is a schematic longitudinal sectional view of a reactor according to a first embodiment.

Hereinafter, reactors according to embodiments of the present invention will be described with reference to the drawings. In the drawings, the same numerals denote the same objects. The dimensional ratios of the drawings do not necessarily coincide with those of the description.

First Embodiment

Overview

Figure 1B:
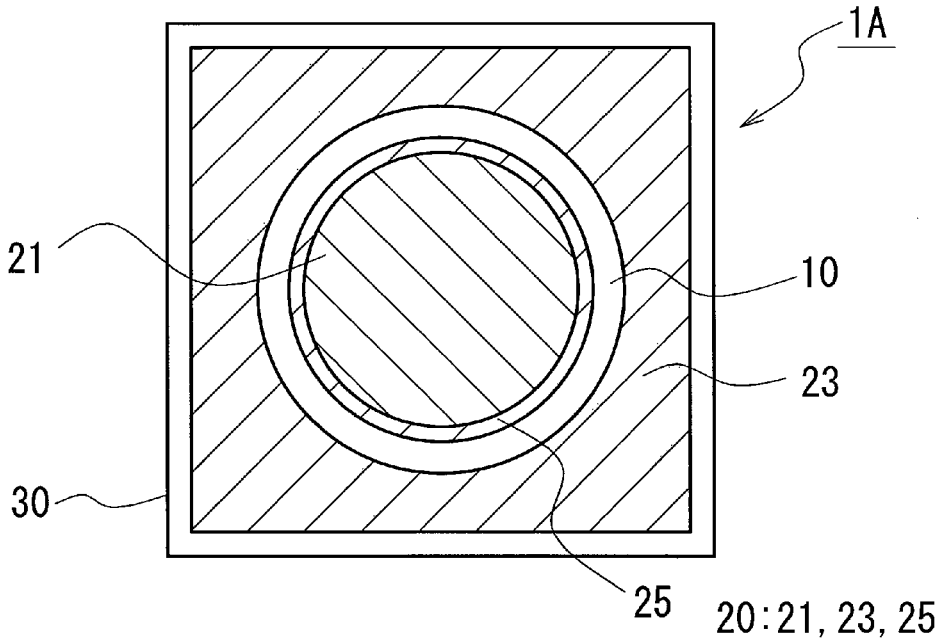
FIG. 1B is a schematic horizontal sectional view of the reactor according to the first embodiment.

As illustrated in FIGS. 1A and 1B, the reactor 1A is a so-called pot-shaped reactor including a coil 10 that is made by winding a wire and a magnetic core 20 in which the coil 10 is disposed. The magnetic core 20 includes an internal core portion 21 and a couple core portion 23. The internal core portion 21 is inserted through the coil 10. The couple core portion 23 covers the outer peripheral surface of the coil 10 and is coupled to an end of the internal core portion 21. Moreover, the reactor 1A includes an interposed core portion 25 between the coil 10 and the internal core portion 21. The reactor 1A according to the present invention is characterized in that the area ratio S2/S1, which is the ratio between the inner cross-sectional area S1 of the coil 10 and the cross-sectional area S2 of the interposed core portion 25, and the saturation magnetic flux densities B1 to B3 of the core portions are in predetermined ranges. Hereinafter, each of the components will be described in detail.

Coil

The coil 10 is a cylindrical body that is made by helically winding a single continuous wire. It is preferable that the wire be an insulated wire that includes a conductor and an insulation coating that covers the outer periphery of the conductor. The conductor is made from a conducting material such as copper or aluminium, and the insulation coating is made from an insulating material. Here, an insulated rectangular wire, which includes a rectangular copper conductor wire and an insulation coating made from an enamel, is used. The insulating material of the insulation coating is typically a polyamide-imide. It is preferable that the thickness of the insulation coating be in the range of 20 μm to 100 μm. The thicker, the smaller the number of pin holes and the higher the insulation resistance. Instead of a wire including a rectangular conductor, various wires including a conductor having circular cross section, polygonal cross section, and the like can be used. The coil 10 is made by winding the insulated rectangular wire edgewise into a cylindrical shape. An edgewise-wound coil can be made comparatively easily when the coil 10 has a cylindrical shape. Alternatively, the coil may have a hollow rectangular parallelepiped shape. The number of turns of the coil 10 is, for example, in the range of about 30 to 60.

Both ends (not shown) of the wire of the coil 10 are appropriately drawn out from a turn portion of the coil 10 to the outside of the couple core portion 23 described below. Terminal members (not shown) are connected to the conductors of the wire, which have been exposed by stripping off the insulation coating. An external apparatus (not shown) for supplying electric power to the coil 10, such as an electric power supply, is connected to the coil 10 through the terminal members. The conductor portions of the wire and the terminal members are connected to each other by welding such as TIG welding or by crimping. The ends of the wire may be drawn out in any appropriate direction such as the axial direction of the coil 10. Alternatively, the ends of the wire may be drawn out in a direction that is perpendicular to the axial direction of the coil 10, or may be drawn out in directions different from each other.

Magnetic Core

The magnetic core 20 includes the internal core portion 21, the couple core portion 23, and the interposed core portion 25. The internal core portion 21 has a cylindrical shape and is inserted through the coil 10. The couple core portion 23 is formed so as to cover both end portions of the internal core portion 21 and the outer peripheral surface of the coil 10. The interposed core portion 25 is interposed between the coil 10 and the internal core portion 21. In the magnetic core 20, the internal core portion 21, the couple core portion 23, and the interposed core portion 25 have different magnetic characteristics because these portions are made from different materials. To be specific, the internal core portion 21 has a saturation magnetic flux density higher than those of the couple core portion 23 and the interposed core portion 25.

<<Internal Core Portion>>

The internal core portion 21 has an outer shape that follows the shape of the inner peripheral surface of the coil 10, and the entirety of the internal core portion 21 is made from a powder molded product. In the present embodiment, the internal core portion 21 is a cylindrical body.

Typically, a powder molded product is obtained by molding soft magnetic powder having an insulation coating, and then baking the molded product at a temperature that is equal to or lower than the upper limit temperature of the insulation coating. Instead of the soft magnetic powder, mixture powder including the soft magnetic powder and an appropriate amount of binder may be used, or powder including a silicone resin as the insulation coating may be used. The saturation magnetic flux density of a powder molded product can be changed by adjusting the material of the soft magnetic powder, the mixture ratio of the soft magnetic powder to the binder, and the amounts of various coatings. For example, a powder molded product having a high saturation magnetic flux density can be obtained by using soft magnetic powder having a high saturation magnetic flux density or by reducing the amount of binder and increasing the proportion of the soft magnetic material. Moreover, the saturation magnetic flux density can be increased by changing the molding pressure, or to be specific, by increasing the molding pressure. It is preferable that the material of the soft magnetic powder be selected and the molding pressure be adjusted so that the powder molded product may have a desired saturation magnetic flux density.

The soft magnetic powder may be powder of an iron group metal such as Fe, Co, or Ni; powder of an iron-based alloy such as Fe—Si, Fe—Ni, Fe—Al, Fe—Co, Fe—Cr, Fe—Si—Al, or the like; or powder of a rare-earth metal; or ferrite powder. In particular, a powder molded product having a high saturation magnetic flux density can be easily made from powder of an iron-based alloy. Such powder can be produced by using an atomization method (using gas or water) or a mechanical pulverization method. A powder molded product having a high anisotropy and a low coercive force can be obtained by using powder made from a nanocrystalline material having a nanosized crystalline structure, or more preferably by using powder made from an anisotropic nanocrystalline material.

The insulation coating formed on the soft magnetic powder may be made from, for example, a phosphate compound, a silicon compound, a zirconium compound, an aluminium compound, or a boron compound. The binder is, for example, a thermoplastic resin, a non-thermoplastic resin, or a higher fatty acid. The binder may be eliminated or changed into an insulator such as silica in the baking step. Because a powder molded product includes an insulator such as an insulation coating, soft magnetic particles are insulated from one another, and therefore eddy-current loss can be reduced. In particular, the loss can be reduced even if high-frequency electric power is supplied to the coil 10. As the powder molded product, a powder molded product of a known type may be used. For example, a powder molded product including particles made from the soft magnetic material that are coated with a multilayer coating that sequentially includes the insulation coating, a heat resistant layer, and a flexible layer may be used (such a soft magnetic material is described in Japanese Unexamined Patent Application Publication No. 2006-202956). Examples of the heat resistant layer include a layer made from a material that includes an organic silicon compound and that has a siloxane cross-linking density higher than 0 and equal to or lower than 1.5. Examples of the flexible layer include a layer made from at least one of a silicone resin, an epoxy resin, a phenolic resin, and an amide resin.

The entirety of the internal core portion 21 may be a solid body made from a powder molded product, or the internal core portion 21 may include segments, each of which is made from a powder molded product, and gap members, air gaps, and adhesive members interposed between the segments. In the former case, due to the gapless structure, the problem of leakage flux (schematically illustrated by broken lines in FIG. 1A) due to the presence of gaps can be alleviated. In the latter case, the inductance of the reactor 1A can be easily adjusted by forming the gaps. In the present embodiment, the internal core portion 21 is a solid body made from a powder molded product.

The length of the internal core portion 21 may be equal to, slightly longer than, or slightly shorter than the length of the coil 10 in the axial direction (hereinafter, simply referred to as the length of the coil 10). However, it is preferable that the length of the internal core portion 21 be equal to or larger than the length of the coil 10 because, in this case, magnetic flux generated by the coil 10 can sufficiently pass through the internal core portion 21.

In the case where the end surfaces of the internal core portion 21 protrude from the end surfaces of the coil 10, the protruding length at one end of may be different from the protruding length at the other end. For example, in the reactor 1A illustrated in FIGS. 1A and 1B, the coil 10 and the magnetic core 20 are disposed in a case 30 described below. The protruding length at the upper end of the internal core portion 21 is larger than the protruding length at the lower end of the internal core portion 21, and the lower end surface of the internal core portion 21 is disposed on the bottom surface of the case 30. By doing so, the internal core portion 21 can be stably mounted in the case 30, and thereby the couple core portion 23, which will be described below, can be easily formed.

Here, the internal core portion 21 is made from a powder molded product made of a soft magnetic material including a silicone coating formed on a phosphate coating. The saturation magnetic flux density B1 of the internal core portion 21 is 1.8 T, and the relative magnetic permeability of the internal core portion 21 is 250. It is preferable that the saturation magnetic flux density B1 be equal to or higher than 1.6 T and equal to or higher than 1.2 times the saturation magnetic flux density B2 of the couple core portion 23. It is preferable that the relative magnetic permeability be in the range of 100 to 500.

<<Couple Core Portion>>

The couple core portion 23 is coupled to both end portions of the internal core portion 21 and covers the outer peripheral surface of the coil 10. The couple core portion 23 may be coupled to an outer peripheral surface of an end portion of the internal core portion 21 or may be coupled to an end surface of the internal core portion 21. In FIG. 1A, the lower end of the internal core portion 21 has the former coupling structure and the upper end of the internal core portion 21 has the latter coupling structure. Coupling structures at both ends of the internal core portion 21 may be the same. The couple core portion 23 and the internal core portion 21 of the magnetic core 20 form a closed magnetic circuit.

A mixture (hardened molded product) of a magnetic material and a resin may be preferably used as the material of the couple core portion 23. By using a hardened molded product as the couple core portion 23, the coil 10, the internal core portion 21, and the interposed core portion 25 described below can be integrated with one another through the resin material of the couple core portion 23 without using an adhesive. Typically, the hardened molded product can be made by injection molding or cast molding.

In the case of injection molding, powder of a magnetic material (if necessary, mixture powder that further includes non-magnetic powder) and a fluid binder resin are mixed with each other to obtain a mixture fluid, the mixture fluid is injected into a mold and molded while applying a predetermined pressure, and then the binder resin is hardened. In the case of cast molding, a mixture fluid the same as that of injection molding is obtained, the mixture fluid is injected into a mold and molded without applying a pressure, and then the mixture fluid is hardened.

In either molding method, soft magnetic powder that is the same as that used for the internal core portion 21 may be used as a magnetic material. In particular, as the soft magnetic powder used for the couple core portion 23, an iron-based material such as pure iron powder or an iron-based alloy powder composed of particles having an average diameter in the range of 10 μm to 500 μm may be preferably used. In general, an iron-based material has a saturation magnetic flux density higher than that of a magnetic material such as ferrite. Therefore, the couple core portion 23 having a high saturation magnetic flux density can be obtained by using powder made from an iron-based material. Coated powder composed of particles that are made from a soft magnetic material and that are coated with a coating made from a ferric phosphate or the like may be used.

In either molding method, a thermosetting resin such as an epoxy resin, a phenolic resin, or a silicone resin may be preferably used as a binder resin. If a thermosetting resin is used as the binder resin, the resin is hardened by heating the molded product. A room-temperature setting resin or a cold setting resin may be used as the binder resin. In this case, the resin is hardened by letting the molded product stand at a room temperature or at a comparatively low temperature. A large amount of the binder resin, which is a non-magnetic material, remains in the hardened molded product. Therefore, the saturation magnetic flux density and the magnetic permeability of the hardened molded product are lower than those of the powder molded product that forms the internal core portion 21 even if the same material is used.

In addition to the powder of the magnetic material and the binder resin, the material of the couple core portion 23 may further include a filler made from a ceramic such as alumina or silica. While the mixture of powder of the magnetic material such as an iron-based material and the binder resin is being hardened, the powder may settle under its own weight and thereby the density of the magnetic material in the couple core portion 23 may become nonuniform. By mixing the filler with the material of the couple core portion, settling of the powder of the magnetic material is suppressed and the powder of the magnetic material is more likely to become uniformly dispersed in the couple core portion. Moreover, if the filler is made from a ceramic, for example, heat dissipation efficiency can be increased. The proportion of the filler is, for example, in the range of 20 to 70 volume % when the volume of the couple core portion 23 is 100%.

When using the injection molding method or the cast molding method, the magnetic permeability and the saturation magnetic flux density of the couple core portion 23 can be adjusted by changing the ratio between the powder of the magnetic material and the binder resin, or if the filler described above is included, by changing the ratio among the powder of the magnetic material, the binder resin, and the filler. For example, the magnetic permeability tends to decrease when the proportion of the powder of the magnetic material is reduced. The magnetic permeability and the saturation magnetic flux density of the couple core portion 23 may be adjusted so that the reactor 1A may have a desired inductance.

Here, the couple core portion 23 is made from a hardened molded product composed of an epoxy resin and powder of an iron-based material including particles having an average diameter equal to or smaller than 100 μm and coated by the coating described above. The saturation magnetic flux density B2 of the couple core portion 23 is 1 T, and the relative magnetic permeability of the couple core portion 23 is 10. It is preferable that the saturation magnetic flux density B2 be equal to or higher than 0.5 T and lower the saturation magnetic flux density B1 of the internal core portion 21. It is preferable that the relative magnetic permeability be in the range of 5 to 50 and more preferably in the range of 5 to 30.

<<Interposed Core Portion>>

Moreover, the interposed core portion 25 is formed between the coil 10 and the internal core portion 21. At least a part of the space between the coil 10 and the internal core portion 21 is filled with the interposed core portion 25. Because leakage flux from the internal core portion 21 passes through the interposed core portion 25, increase in the loss due to passage of the leakage flux through the coil 10 is suppressed.

As with the couple core portion 23, it is preferable that the interposed core portion 25 be made from a hardened molded product. By forming the interposed core portion 25 from the hardened molded product, each of the coil 10, the internal core portion 21, and the couple core portion 23 can be easily integrated with the interposed core portion 25. In this case, the materials of the interposed core portion 25 and the couple core portion 23 may be the same or may be different. The materials are different not only if at least one of the magnetic material and the resin material of the hardened molded product are different but also if the same magnetic material and the same resin are mixed with different proportions. In particular, by forming the interposed core portion 25 and the couple core portion 23 from the same material, the couple core portion 23 and the interposed core portion 25 can be simultaneously formed by placing the internal core portion 21 in the coil 10 and by filling the space around the coil 10 with a mixture of a magnetic material and a resin and by hardening the mixture.

It is preferable that there be no spaces between the outer peripheral surface of the interposed core portion 25 and the inner peripheral surface of the coil 10. That is, by filling the space between the internal core portion 21 and the coil 10 with the interposed core portion 25, leakage flux from the internal core portion 21 can be easily restrained from passing through the coil 10. This space can be substantially eliminated by using the same material for the interposed core portion 25 and the couple core portion 23, disposing the internal core portion 21 inside the coil 10, filling the space around the internal core portion 21 with a mixture of a magnetic material and a resin, and hardening the mixture.

Here, as with the couple core portion 23, the interposed core portion 25 is formed from a hardened molded product composed of coated powder and an epoxy resin. The coated powder is iron-based powder having an average diameter equal to or smaller than 100 μm and coated with the coating described above. Therefore, the saturation magnetic flux density B3 of the interposed core portion 25 is 1 T and the relative magnetic permeability of the interposed core portion 25 is 10. It is preferable that the saturation magnetic flux density B3 be equal to or higher than 0.5 T and lower than the saturation magnetic flux density B1 of the internal core portion 21. It is preferable that the relative magnetic permeability be in the range of 5 to 50 and more preferably be in the range of 5 to 30.

<<Area Ratio>>

The reactor 1A, which includes the coil 10, the internal core portion 21, and the interposed core portion 25, satisfies $0<S2/S1<0.15$, where S1 is the inner cross-sectional area of the coil 10 and S2 is the cross-sectional area of the interposed core portion 25. The inner cross-sectional area of the coil 10 S1 is the area of a region inside the turns of the coil 10 when the coil 10 is seen in the axial direction. The cross-sectional area S2 of the interposed core portion 25 is the area of a cross section of the interposed core portion 25 cut along a plane perpendicular to the axial direction of the coil 10. The internal core portion 21 usually has a uniform cross-sectional area in the longitudinal direction thereof, and the interposed core portion 25, which is formed on the outer periphery of the internal core portion 21, has a uniform cross-sectional area in the longitudinal direction thereof. If the cross-sectional area of the interposed core portion 25 is not uniform in the longitudinal direction of the interposed core portion 25, the maximum cross-sectional area of the interposed core portion 25 is defined as the cross-sectional area S2.

If the area ratio is in the range $0<S2/S1<0.15$, the ratio of the total loss to the inductance of the reactor 1A can be reduced as can be clearly seen from the examples described below. That is, the rate of increase in the total loss can be restrained and the inductance can be increased. Therefore, the same inductance can be realized with a reactor having a smaller volume, and the size of the reactor 1A can be reduced. However, if the area ratio exceeds the upper limit of this range, a region occupied by the interposed core portion 25, which has a low saturation magnetic flux density, increases inside the coil 10, so that it becomes difficult to reduce the size of the reactor 1A. It is more preferable that the area ratio be in the range $0<S2/S1<0.04$. If this range is satisfied, the ratio of the copper loss to the inductance of the reactor 1A can be reduced. That is, the rate of increase in the copper loss can be restrained and the inductance can be increased. Therefore, the same inductance can be realized with a reactor having a smaller volume, and the size of the reactor 1A can be reduced further.

The area ratio S2/S 1 can be adjusted by appropriately selecting the inside diameter of the coil 10 and the outside diameter of the internal core portion 21. This is because the interposed core portion 25 is formed by filling the space between the coil 10 and the internal core portion 21 with a mixture of a magnetic material and a resin.

<<Saturation Magnetic Flux Density>>

The reactor 1A according to the present invention satisfies B1>B2 and B1>B3, where B1 is the saturation magnetic flux density of the internal core portion 21, B2 is the saturation magnetic flux density of the couple core portion 23, and B3 is the saturation magnetic flux density of the interposed core portion 25. By forming the core portions so as to satisfy these conditions, the size of the reactor 1A can be reduced by decreasing the diameter of the internal core portion 21, and the reactor 1A having low loss can be realized by suppressing leakage flux from the internal core portion 21 to the coil 10.

It is preferable that the saturation magnetic flux density B3 of the interposed core portion 25 be the same as the saturation magnetic flux density B2 of the couple core portion 23. However, B3 may be different from B2. That is, either B1>B3>B2 or B1>B2>B3 may be satisfied.

Other Components

<<Insulator>>

In order to increase the insulation resistance between the coil 10 and the magnetic core 20, it is preferable that an insulator (not shown) be interposed between the magnetic core 20 and a part of the coil 10 that comes into contact with the magnetic core 20. For example, insulation tape may be applied to the inner and outer peripheral surfaces of the coil 10, or insulating paper or an insulation sheet may be disposed on the inner and outer peripheral surfaces of the coil 10. A bobbin (not shown) made from an insulating material may be disposed on an outer periphery of the internal core portion 21. The bobbin may be a cylindrical body that covers the outer periphery of the internal core portion 21. By using a bobbin including an annular flange extending in the circumferential direction from both ends of the cylindrical body, the insulation resistance between the end surfaces of the coil 10 and the couple core portion 23 can be increased. As the material of the bobbin, an insulating resin such as a polyphenylene sulfide (PPS) resin, a liquid crystal polymer (LCP), or a polytetrafluoroethylene (PTFE) resin may be preferably used.

<<Case>>

The reactor 1A illustrated in FIGS. 1A and 1B includes the case 30 for containing an assembly including the coil 10 and the magnetic core 20. The assembly including the coil 10 and the internal core portion 21 is sealed in the case 30 by the resin included in the couple core portion 23. That is, the resin material of the couple core portion 23 also functions as a sealant for the coil 10 and the internal core portion 21. The case 30 contains the coil 10 in such a way that the axial direction of the coil 10 is perpendicular to a surface that is located adjacent to a mount object (not shown) when the reactor 1A is mounted on the mount object (the lower surface in FIG. 1A). The orientation of the coil 10 in the case 30 may be appropriately selected.

The material and the shape of the case 30 may be appropriately selected. For example, the case 30 may have a cylindrical shape that follows the shape of the assembly. Here, the case 30 is a box-shaped body that is made from a metal such as aluminium, that includes the rectangular bottom surface and sidewalls standing from the bottom surface, and that has an opening at one end thereof.

To be specific, the case 30 includes guide protrusions, a positioning portion, and a coil supporting portion (not shown). The guide protrusions, which protrude from the inner peripheral surfaces of the sidewalls, prevent the coil 10 from being rotated and function as guides when inserting the coil 10. The positioning portion, which protrudes from a corner of the inner peripheral surface the case 30, is used to position an end of the wire. The coil supporting portion, which is disposed on the inner peripheral surface of the case 30 and protrudes from the bottom surface, supports the coil 10 and determines the height of the coil 10 with respect to the case 30. By using the case 30 including the guide protrusions, the positioning portion, and the coil supporting portion, the coil 10 can be disposed at a desired position in the case 30 with a high precision, and the position of the internal core portion 21 with respect to the coil 10 can be determined with a high precision. The case 30 need not include the guide protrusions, the positioning portion, and the coil supporting portion at all, or may include at least one of these portions. These portions may be integrally formed with the case 30 as a part of the case 30. Alternatively, independent members may be prepared and disposed in the case 30, and may be used as the guide protrusions and the like. If the independent members contained in the case 30 are hardened molded products made from a material the same as that of the couple core portion 23, the independent members can be easily integrated with the couple core portion 23 when forming the couple core portion 23 (the interposed core portion 25) and the independent members can be used as a magnetic path. The case 30 may includes attachment portions in which bolt holes are formed. The bolt holes are used to fix the reactor 1A to a mount object (not shown) by using bolts. If the case 30 has the attachment portions, the reactor 1A can be easily fixed to a mount object with bolts.

Applications

The reactor 1A having the configuration described above can be preferably used in applications under electrical conditions such as the maximum current (direct current) in the range of about 100 A to 1000 A, the average voltage in the range of about 100 V to 1000 V, and the used frequency in the range of about 5 kHz to 100 kHz. A typical application is the use as a component of a vehicle-mounted converter of an electric vehicle or a hybrid vehicle. For this application, the reactor 1A can be preferably used by adjusting the inductance when the direct current is 0 A to a value in the range of 10 μH to 1 mH, and by adjusting the inductance at the maximum current to be equal to or higher than 30% of the value of the inductance when the current is 0 A.

Size of Reactor

The size of the reactor 1A having the configuration described above may be appropriately selected as long as the reactor 1A has a desired inductance and satisfies the area ratio and the saturation magnetic flux densities described above. For example, in the case where the reactor 1A is used as a vehicle component, the volume of the reactor 1A including the case 30 is in the range of about 0.2 liter (200 $cm^3$) to 0.8 liter (800 $cm^3$) (here, 230 $cm^3$). Because the size of the reactor 1A satisfies these conditions, the reactor 1A is small and can be preferably used as a vehicle component.

Method of Manufacturing Reactor

The reactor 1A can be manufactured as follows. First, the coil 10 and the internal core portion 21 made from a powder molded product are prepared. An assembly including the coil 10 and the internal core portion 21 is made by inserting the internal core portion 21 into the coil 10. An insulator may be appropriately disposed between the coil 10 and the internal core portion 21 as described above.

Next, the assembly is placed in the case 30. The assembly can be disposed at a predetermined position in the case 30 with high precision by using the above-mentioned guide protrusions and the like. A mixture fluid including a magnetic material and a binder resin, which will form the couple core portion 23 and the interposed core portion 25, is appropriately poured into the case 30; the couple core portion 23 and the interposed core portion 25 having predetermined shapes are formed; and the reactor 1A is obtained by hardening the binder resin.

Alternatively, the reactor 1A may be manufactured as follows. First, the internal core portion 21 is placed in a mold having a cylindrical shape, a mixture fluid including a magnetic material and a binder resin, which will form the interposed core portion 25, is appropriately poured into the space between the mold and the internal core portion 21, and the binder resin is hardened. Next, a molded product is removed from the mold, thereby obtaining a composite core portion in which the internal core portion 21 and the interposed core portion 25 are integrated with each other. Subsequently, the composite core portion is inserted into the coil 10, and an assembly including the coil 10 and the composite core portion is disposed in the case 30. Then, a mixture fluid, which will form the couple core portion 23, is poured into the case 30 and the binder resin is hardened, thereby obtaining the reactor 1A. With this method, the couple core portion 23 and the interposed core portion 25 can be made from different materials.

Operational Effect

In the reactor 1A, the saturation magnetic flux density of the internal core portion 21 is higher than that of the couple core portion 23. Therefore, as compared with the case where the saturation magnetic flux density of the entirety of the magnetic core 20 is uniform, the same amount of magnetic flux can be obtained by using the internal core portion 21 having a smaller cross-sectional area (the area of a surface through which magnetic flux passes). Moreover, because the interposed core portion 25 is disposed between the internal core portion 21 and the coil 10 and the area ratio S2/S1 of the interposed core portion 25 is limited in the predetermined range, leakage flux from the internal core portion 21 is restrained from entering the coil 10 and the loss of the reactor 1A can be reduced.

In the reactor 1A, there are no gap members in the entirety of the magnetic core 20. Therefore, the coil 10 is not influenced by leakage flux from gaps, so that loss can be reduced also in this respect.

Moreover, the reactor 1A according to the present embodiment has a high productivity because the reactor 1A has an adhesiveless structure, which can be manufactured without using an adhesive at all, and the internal core portion 21 can be formed without performing a step of joining a gap member or the like. In particular, the reactor 1A can be manufactured by forming the magnetic core 20 by joining the internal core portion 21 and the couple core portion 23 to each other, joining the internal core portion 21 and the interposed core portion 25 to each other, and joining the interposed core portion 25 and the couple core portion 23 to each other through the resin material of the couple core portion 23 simultaneously with forming the couple core portion 23 and the interposed core portion 25. Therefore, the reactor 1A can be manufactured with a small number of steps, and the reactor 1A has a high productivity also in this respect. Furthermore, because the internal core portion 21 of the reactor 1A is a powder molded product, the saturation magnetic flux density of the internal core portion 21 can be easily adjusted and a complex three-dimensional shape can be easily formed, so that the reactor 1A has a high productivity also in this respect.

Because the reactor 1A includes the case 30, the assembly including the coil 10 and the magnetic core 20 can be protected against the external environment such as dust and corrosion and can be protected mechanically. In particular, because the couple core portion 23 and the interposed core portion 25 include a resin component, the coil 10 and the internal core portion 21 can be protected against the external environment and can be mechanically protected even if the case 30 has an opening. In addition, because the case 30 is made from a metal, the case 30 can be used as a heat dissipation path, and thereby the reactor 1A has a high heat dissipation efficiency. In particular, because the internal core portion 21, in which the coil 10 is disposed, is in contact with the case 30, heat can be efficiently dissipated from the coil 10.

Second Embodiment

Figure 2A:
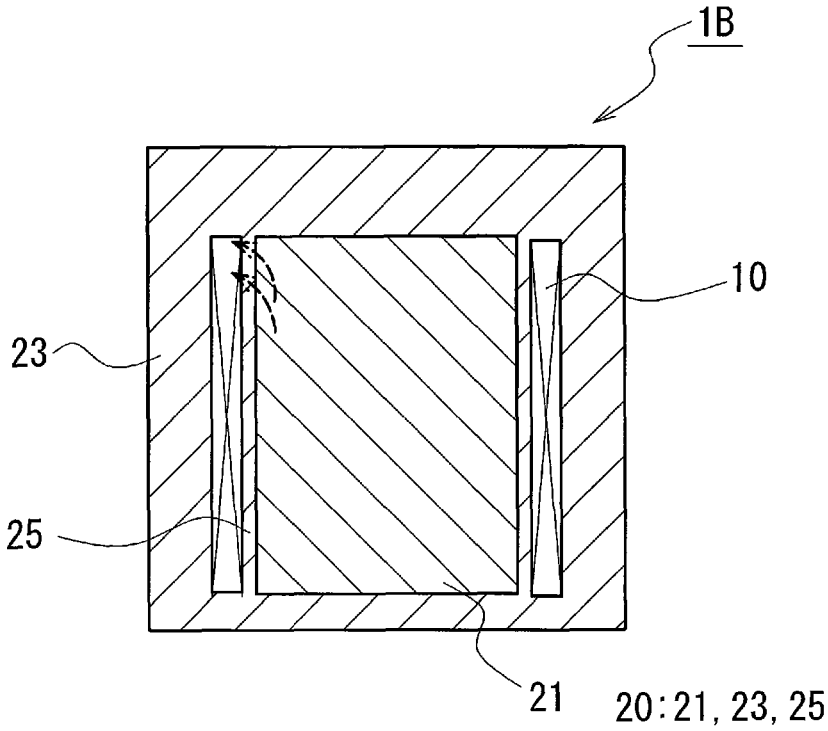
FIG. 2A is a schematic longitudinal sectional view of the reactor according to a second embodiment.

Next, referring to FIG. 2A, a second embodiment will be described. The second embodiment differs from the first embodiment in the configurations of the internal core portion 21 and the couple core portion 23. The difference between the second embodiment and the first embodiment will be mainly described below. Description of other configurations will be omitted because they are the same as those of the first embodiment.

The reactor 1B differs from the first embodiment in that the couple core portion 23 is also coupled to the lower end surface of the internal core portion 21. That is, the configurations of the upper and lower end portions of the internal core portion 21 can be made more uniform.

The reactor 1B does not have a case. The reactor 1B can be obtained by placing an assembly including the coil 10 and the internal core portion 21 in a mold and pouring a mixture fluid, which will form the couple core portion 23 and the interposed core portion 25, into the mold. The coil 10 and the internal core portion 21 are retained at a distance from the bottom surface of the mold. To enable the retention, a supporting block made from a material the same as that of the couple core portion 23 (the interposed core portion 25) may be placed on the bottom surface of the mold and the coil 10 and the internal core portion 21 may be placed on the supporting block. Then, a binder resin included in the mixture fluid is hardened, a molded product is removed from the mold, thereby obtaining the reactor 1B. By using segmented dies, a molded product can be easily removed from the mold after the resin of the couple core portion 23 and the interposed core portion 25 has been hardened.

The reactor 1B according to the second embodiment is the same as that of the first embodiment in that the interposed core portion 25 is formed between the internal core portion 21 and the coil 10 and the interposed core portion 25 is made from a material the same as that of the couple core portion 23.

With the reactor 1B, the configurations of the upper and lower end portions of the internal core portion 21 can be made more uniform and magnetic flux that passes through the magnetic core 20 can be made more uniform.

Third Embodiment

Figure 2B:
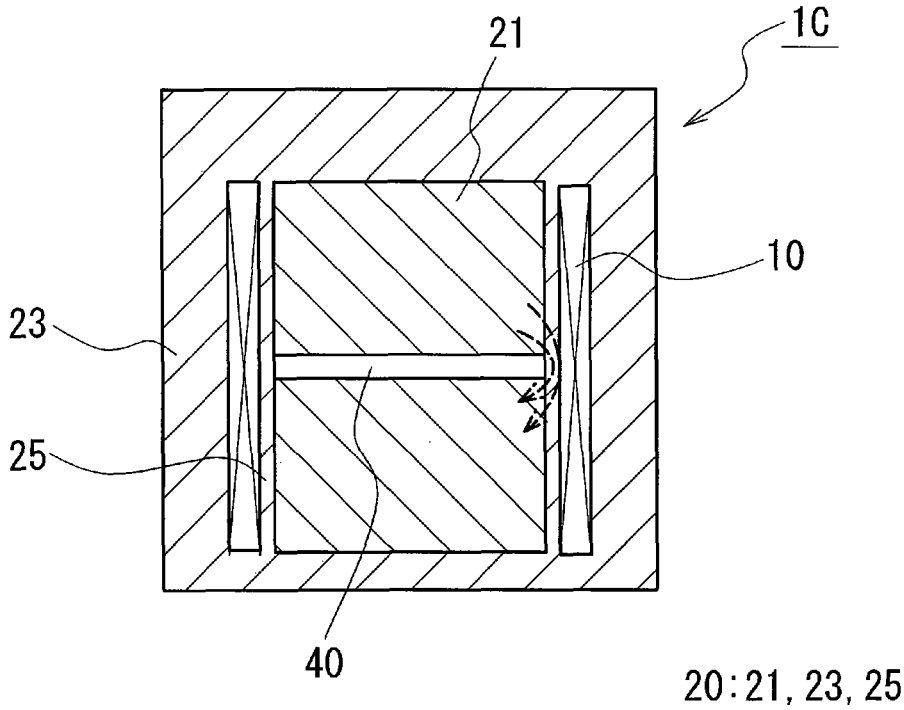
FIG. 2B is a schematic longitudinal sectional view of a reactor according to a third embodiment.

Next, referring to FIG. 2B, a third embodiment, in which a gap is provided at an intermediate position in the internal core portion 21, will be described. The difference between the third embodiment and the second embodiment will be mainly described below. Description of other configurations will be omitted because they are the same as those of the first embodiment.

In the reactor 1C, the internal core portion 21 includes a plurality of segments, each of which is made from a powder molded product, and a gap 40 interposed between these segments. In the present embodiment, the internal core portion 21 includes two segments. However, the number of the segments is not particularly limited. The gap 40 is used to adjust the inductance of the reactor 1C. A non-magnetic material such as alumina can be preferably used as the gap 40. The number of the gaps 40 is not particularly limited. The number of the gaps 40 may be appropriately selected in accordance of the inductance required for the reactor 1C.

The reactor 1C according to the present embodiment is the same as that of the second embodiment in that the interposed core portion 25 is formed between the internal core portion 21 and the coil 10, the interposed core portion 25 and the couple core portion 23 are made of the same material, and the couple core portion 23 is coupled to both end surfaces of the internal core portion 21.

With the reactor 1C, the inductance of the reactor 1C can be easily adjusted because the gap 40 is disposed at an intermediate position in the internal core portion 21. Although the gap 40 is formed, because the interposed core portion 25 is disposed between the outer periphery of the gap 40 and the coil 10, leakage flux from the outer periphery of the gap 40 is restrained from entering the coil 10, and thereby loss reduction can be realized.

EXAMPLE

By using models of a reactor corresponding to the first embodiment, the total loss of the reactor and the copper loss of the coil were calculated while changing the area ratio S2/S1 described above. In the models used for this calculation, the sizes of the coil, the internal core portion, and the couple core portion were constant, and the interposed core portion was formed between the coil and the internal core portion, so that the models had different area ratios S2/S1. The total loss and the copper loss were normalized assuming that the ratios of the losses to the inductance of the reactor were 1.0 when the area ratio was zero, i.e. when the interposed core portion was not present. Specific conditions of the calculation were as follows. The results of the calculation are shown in Table and FIGS. 3 and 4. In Table, the area ratio is represented by 100×S2/S1 (%).

The inductance of each model used for this calculation was calculated assuming that an electric current of 270 A was passed through the coil. The ratio of the outside diameter of the internal core portion and the inside diameter of the coil is 1:1.15. For this calculation, electromagnetic CAE analysis software JMAG (made by JSOL Corporation) was used.

TABLE

| Area Ratio (%) | (Total loss)/L | (Copper loss)/L |
|---|---|---|
| 0.000 | 1.000 | 1.000 |
| 0.230 | 0.988 | 0.992 |
| 0.461 | 0.986 | 0.992 |
| 0.923 | 0.983 | 0.990 |
| 1.852 | 0.981 | 0.994 |
| 2.318 | 0.979 | 0.996 |
| 2.786 | 0.977 | 0.998 |
| 3.726 | 0.973 | 0.999 |
| 4.672 | 0.969 | 1.002 |
| 5.623 | 0.964 | 1.006 |

TABLE-continued

| Area Ratio (%) | (Total loss)/L | (Copper loss)/L |
|---|---|---|
| 6.580 | 0.960 | 1.009 |
| 7.060 | 0.959 | 1.012 |
| 7.542 | 0.957 | 1.015 |
| 8.511 | 0.955 | 1.020 |
| 9.484 | 0.951 | 1.027 |
| 14.438 | 0.937 | 1.060 |
| 19.532 | 0.931 | 1.113 |

Figure 3:
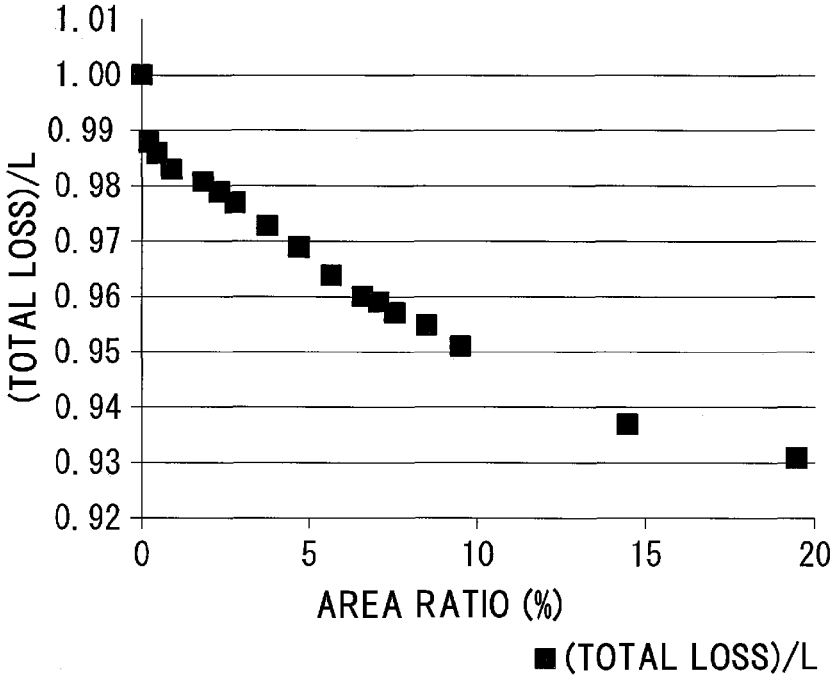
FIG. 3 is a graph illustrating the relationship between the area ratio S2/S1 and (total loss)/L.
Figure 4:
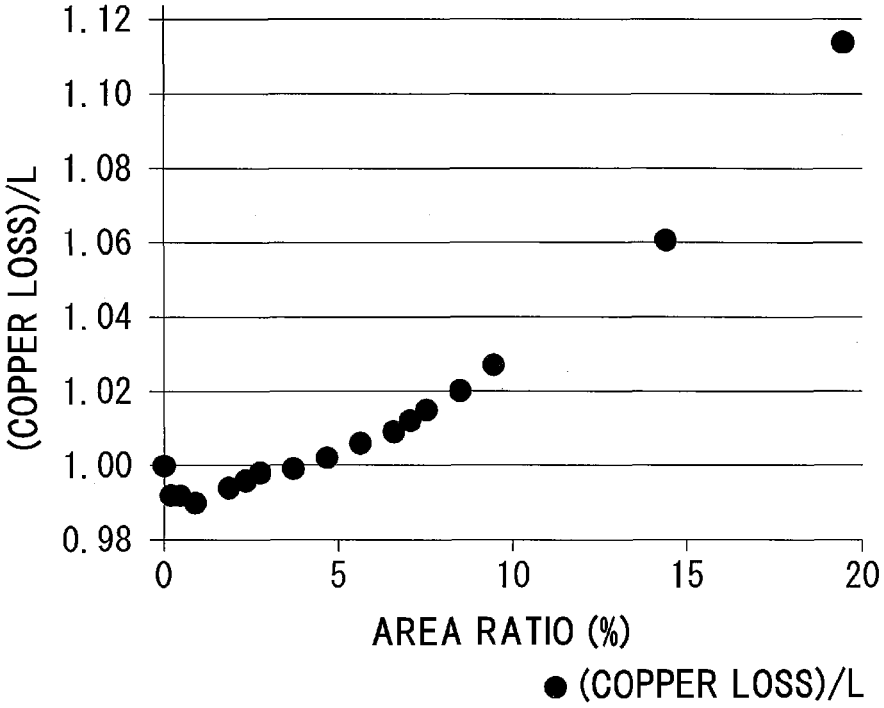
FIG. 4 is a graph illustrating the relationship between the area ratio S2/S1 and (copper loss)/L.

As can be seen from Table and FIG. 3, (total loss)/L was smaller than 1 when the interposed core portion is provided, which indicates that the rate of increase in the inductance is higher than the rate of increase in the loss if the volume of the reactor is constant. That is, it is preferable that the interposed core portion be provided, and in this case, the size of the reactor can be reduced. As can be seen from Table and FIG. 4, (copper loss)/L was smaller than 1 when the area ratio S2/S1 was equal to or smaller than about 0.04, i.e. equal to or smaller than about 4%, which indicates that the inductance can be increased while suppressing an increase in the copper loss if the volume of the reactor is constant. Therefore, in particular, it was confirmed that making the area ratio S2/S1 be equal to or smaller than 0.04 (equal to or smaller than 4%) is effective for suppressing the loss and reducing the size of the reactor. Moreover, it was confirmed that providing the interposed core portion is effective for increasing the inductance on the high-current side.

The embodiments described above can be appropriately modified within the scope of the present invention, and are not limited to the configuration described above.

INDUSTRIAL APPLICABILITY

The reactor according to the present invention can be used as a component of an electric power converter, such as a bidirectional DC-DC converter, that is mounted in a vehicle such as a hybrid vehicle, an electric vehicle, or a fuel-cell vehicle.

REFERENCE SIGNS LIST

1A, 1B, 1C reactor
10 coil
20 magnetic core
21 internal core portion
23 couple core portion
25 interposed core portion
30 case
40 gap

The invention claimed is:

1. A reactor including a coil and a magnetic core, the coil being formed by winding a wire, the magnetic core including an internal core portion that is inserted through the coil and a couple core portion that is coupled to an end of the internal core portion and that covers an outer periphery of the coil, the core portions forming a closed magnetic path, the reactor comprising:

an interposed core portion disposed between the coil and the internal core portion, wherein $0<S2/S1<0.15$ is satisfied, where S1 is an inner cross-sectional area of the coil and S2 is a cross-sectional area of the interposed core portion, and wherein $B1>B2$ and $B1>B3$ are satisfied, where B1 is a saturation magnetic flux density of the internal core portion, B2 is a saturation magnetic flux density of the couple core portion, and B3 is a saturation magnetic flux density of the interposed core portion.

2. The reactor according to claim 1, wherein $0<S2/S1<0.04$ is satisfied.

3. The reactor according to claim 1, wherein the internal core portion is made from a powder molded product.

4. The reactor according to claim 1, wherein the couple core portion and the interposed core portion are each made of a mixture of a magnetic material and a resin, and wherein the internal core portion, the interposed core portion, and the couple core portion are integrated with one another through the resin.

5. The reactor according to claim 1, wherein the saturation magnetic flux density B1 of the internal core portion satisfies $1.6\ T \leq B1$ and $1.2 \times B2 \leq B1$.

6. The reactor according to claim 1, wherein a relative magnetic permeability of the internal core portion is in the range of 50 to 1000, and wherein a relative magnetic permeability of each of the couple core portion and the interposed core portion is in the range of 5 to 50.

7. The reactor according to claim 4, further comprising a case that contains an assembly including the coil and the magnetic core, wherein the coil and the internal core portion are sealed in the case by the resin included in the couple core portion and the interposed core portion.

* * * * *